United States Patent [19]

Allemann

[11] 4,123,097

[45] Oct. 31, 1978

[54] SECTIONAL ENTRANCE HANDLE RETRACT MECHANISM

[75] Inventor: James G. Allemann, Santa Ana, Calif.

[73] Assignee: Norris Industries, Inc., South Gate, Calif.

[21] Appl. No.: 802,043

[22] Filed: May 31, 1977

[51] Int. Cl.[2] ..... E05B 1/16

[52] U.S. Cl. ..... 292/336.3; 292/167

[58] Field of Search ..... 292/92, 173, 167, 336.3; 70/DIG. 60

[56] References Cited

U.S. PATENT DOCUMENTS

| | | | |
|---|---|---|---|
| 2,485,054 | 10/1949 | Lickteig | 292/167 X |
| 3,591,224 | 7/1971 | Unter | 292/167 |

*Primary Examiner*—Richard E. Moore

[57] ABSTRACT

For translating the linear motion of a pivotally mounted thumb piece for a front door latch into the rotary motion needed to withdraw a latch bolt, two rotary members are employed. One is a bell crank having a pivotal mounting on the mounting plate at one side of and at right angles to the pivotal mounting of the thumb plate and rotationally responsive to linear motion of the thumb piece. The other is a drum having a rotatable mounting on the mounting plate parallel to and spaced from the bell crank pivotal mounting, and at a location adjacent a roll back of a latch bolt. A resilient connector strip from the bell crank to the drum causes the drum to be rotated in response to rotation of the bell crank. A torsion return spring attached to the drum acts to return the drum and the bell crank to their original positions.

8 Claims, 11 Drawing Figures

Fig. 1.
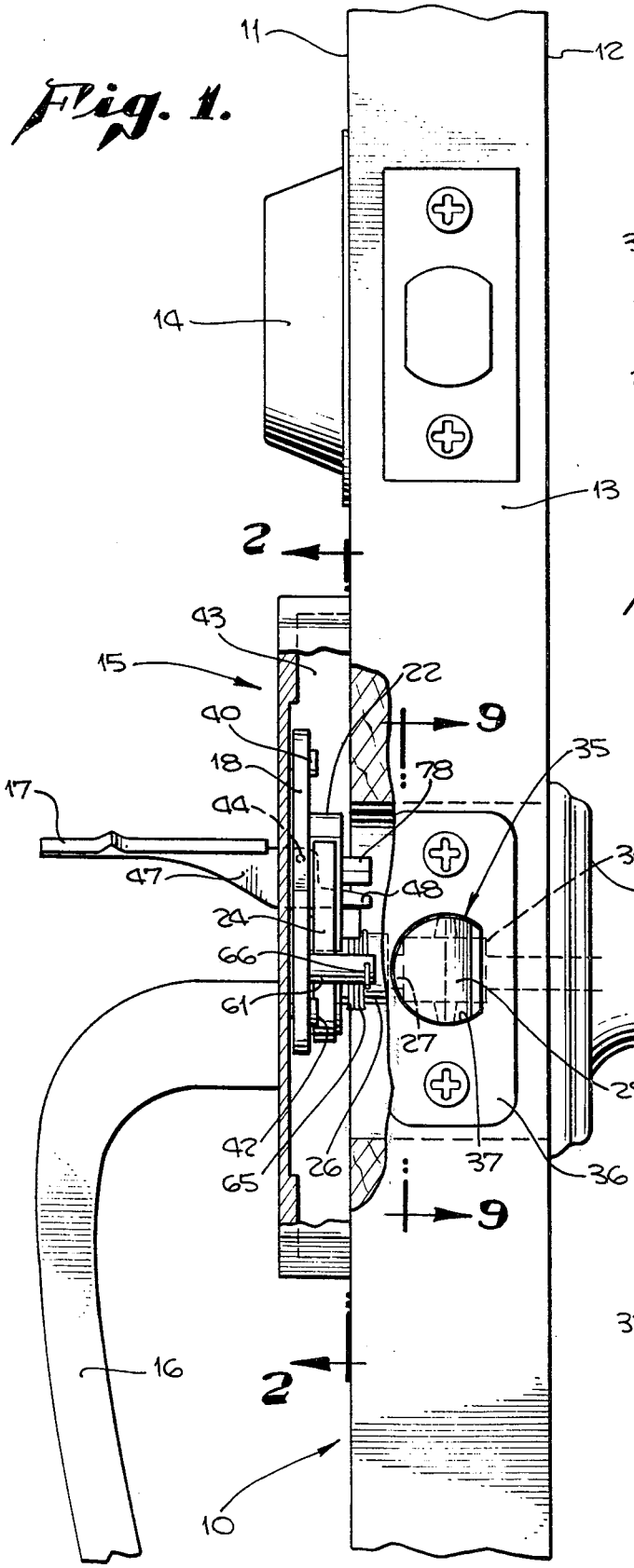
Fig. 9.
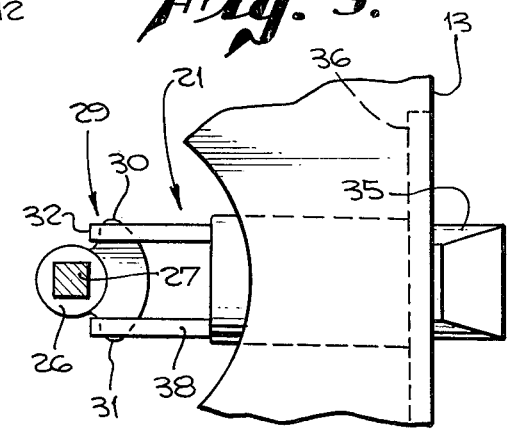
Fig. 11.
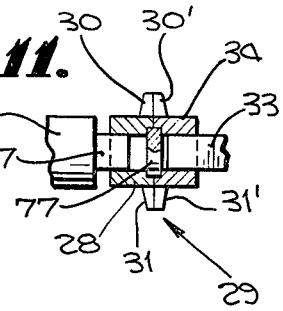
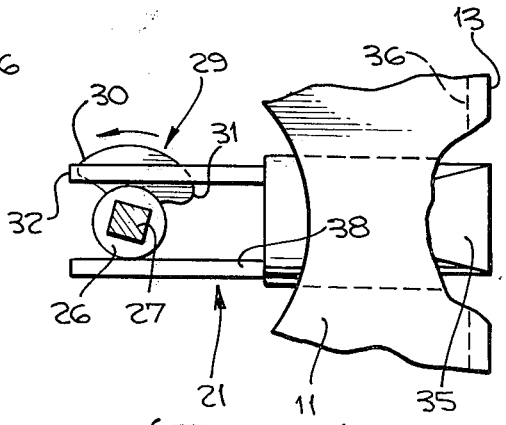
Fig. 10.

4
4

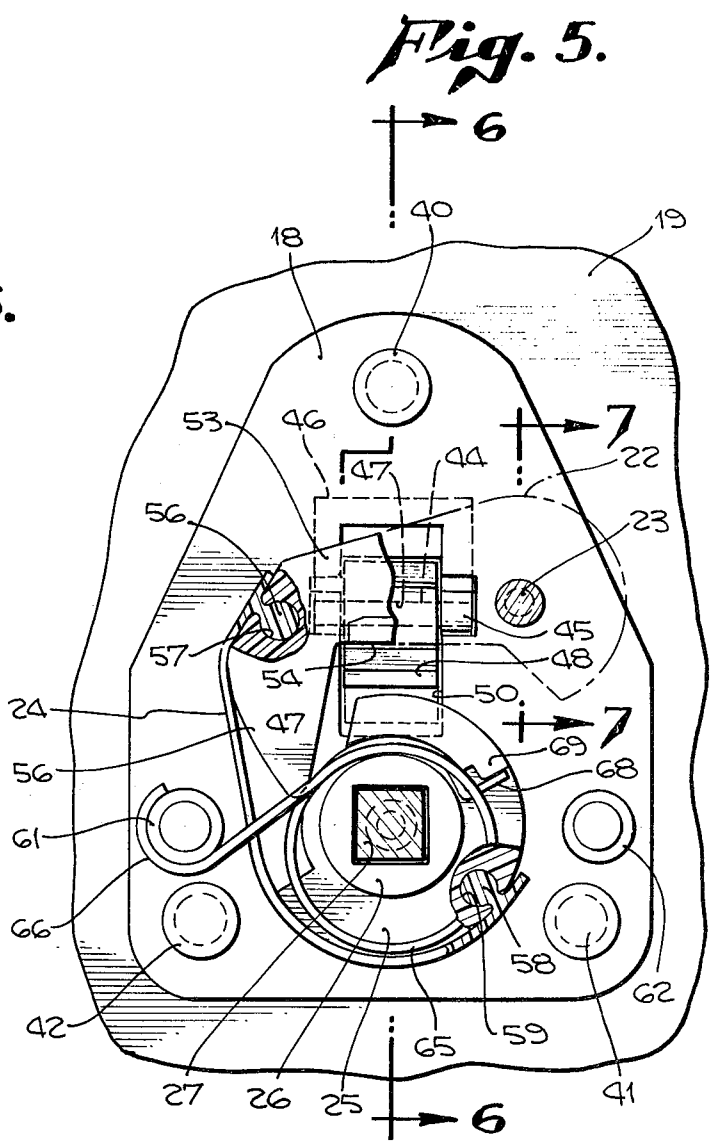
Fig. 5.
6
7
19
22
23
45
48
44
47
46
18
40
53
56
57
54
50
69
68
62
41
58
59
65
25
26
27
42
66
61
56
24
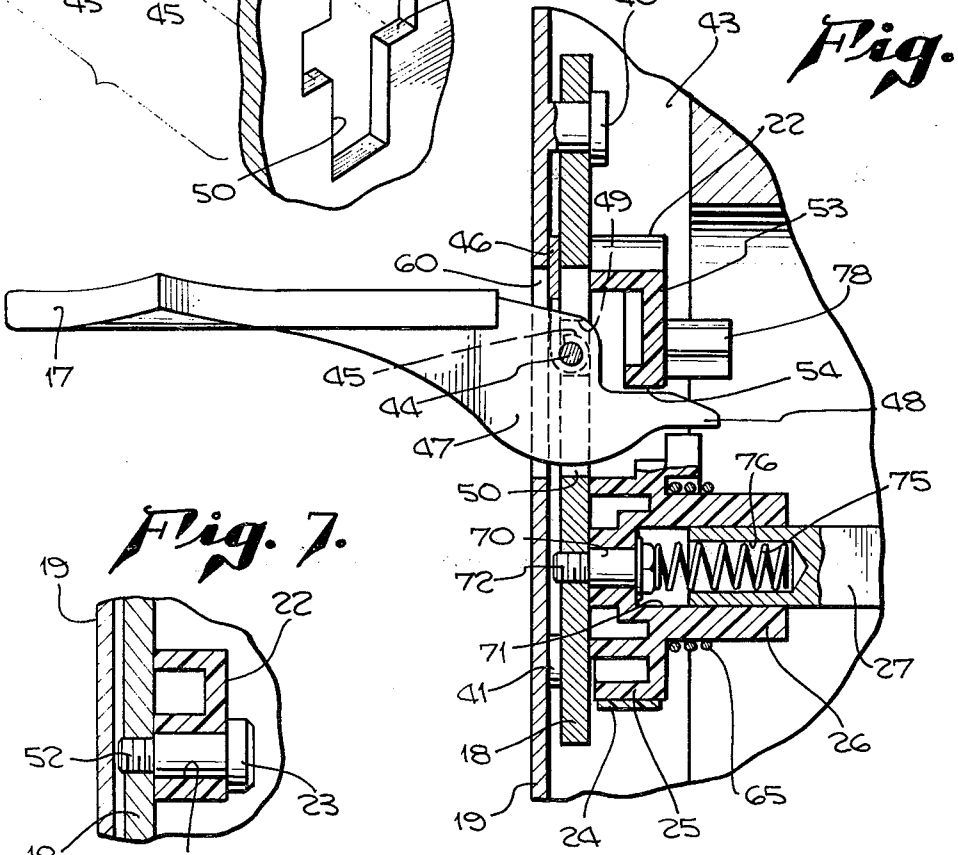
Fig. 6.
40
43
22
53
78
49
46
60
44
45
47
17
48
54
75
76
27
26
65
25
24
50
70
72
71
41
18
19
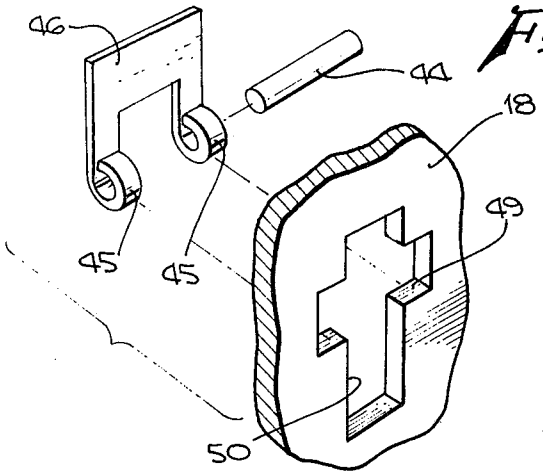
Fig. 8.
18
49
50
44
45
45
46
Fig. 7.
22
23
51
19
52
18

SECTIONAL ENTRANCE HANDLE RETRACT MECHANISM

Although the more commonly expected way to withdraw the latch bolt of a locked door is by rotation of a knob, there are occasions when it becomes desirable to have a handle which can be more firmly and conveniently gripped, especially in order to pull a door open. Such occasions are for doors which may perhaps be somewhat heavier than usual, in order to give the operator a better grip on the door hardware to pull it open. Another such occasion is that of a front door where, for example, because it is more conventional to resort to a door handle or perhaps for the aesthetic appeal, a pull type handle is preferable.

Although the pull type handle may provide a better way to grasp and pull a door into open position, some expedient has to be provided for pulling back the latch bolt from engagement with the frame before the door can be pulled open. Although the latch bolt has to be moved linearly, the more commonly accepted mechanism employed is one of rotating a spindle and than translating rotational movement of shoulders on the spindle through a roll back into the linear motion needed to withdraw the latch bolt.

When a door handle is to be resorted to, it is more natural to provide a thumb piece for unlatching the latch bolt. Since the thumb piece, when manipulated, results in a linear motion, such linear motion must first be translated into rotary motion for the spindle and then again reconverted into linear motion for withdrawing the latch bolt.

Door handles with thumb pieces of the kind made reference to have long been employed for precisely the purpose described. Necessary mechanisms for accomplishing that purpose, however, have been extremely varied. Some variations have been complex for various reasons, among which is to provide the necessary mechanical advantage. The result of such complexity is commonly the need for numerous parts, increasing the number of factory operations, and complicating the positioning of parts in the structure. Where attempts have been made to simplify the parts, they have frequently been cumbersome and hard to manipulate. Gear action, which has been resorted to on occasion, is clearly an unnecessarily expensive construction. Shafts, levers, cams and bell cranks, although capable of translating the motion as needed, often take up considerable space, require a relatively large and bulky housing, thus adding to the initial cost as well as to the installation cost. Where the mechanical parts are numerous, they require tight dimensional and positional tolerances and this adds to expense, as well as increasing the need for servicing. One of the detrimental results is poor reliability, and poor reliability in a door lock is generally highly objectionable.

It is, therefore, among the objects of the invention to provide a new and improved sectional entrance handle retract mechanism, which has a substantially minimum number of components, thereby to minimize initial cost as well as installation cost.

Another object of the invention is to provide a new and improved sectional entrance handle retract mechanism which, because of a reduced number of components and simplified assembly, contributes appreciably to a device which is inexpensive to fabricate.

Still another object of the invention is to provide a new and improved sectional entrance handle retract mechanism which, with its relatively minimum number of components, has a smooth and positive action.

Still another object of the invention is to provide a new and improved sectional entrance handle retract mechanism which, by reason of the interrelationship of the various components, is one wherein the interfacing component cannot get out of synchronization.

Still further among the objects of the invention is to provide a new and improved sectional entrance handle retract mechanism which, once installed, has a high reliability.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 1 is an elevational edge view of a door, showing a sectional entrance handle mechanism mounted thereon partially broken away, and also a conventional dead bolt.

FIG. 5 is an elevational enlarged view of the central portion of the mechanism as positioned with the latch bolt extended.

FIG. 6 is a vertical sectional view on the line 6—6 of FIG. 5.

FIG. 7 is a fragmentary vertical view on the line 7—7 of FIG. 5.

FIG. 8 is a fragmentary exploded view of the hinge for the thumb piece.

FIG. 9 is a side elevational view showing the latch bolt in extended position, taken on the line 9 of FIG. 1.

FIG. 10 is a side elevational view similar to FIG. 9, but showing the latch bolt retracted.

FIG. 11 is a fragmentary longitudinal sectional view of the interconnection of spindle elements.

Figures 2, 3, 4:
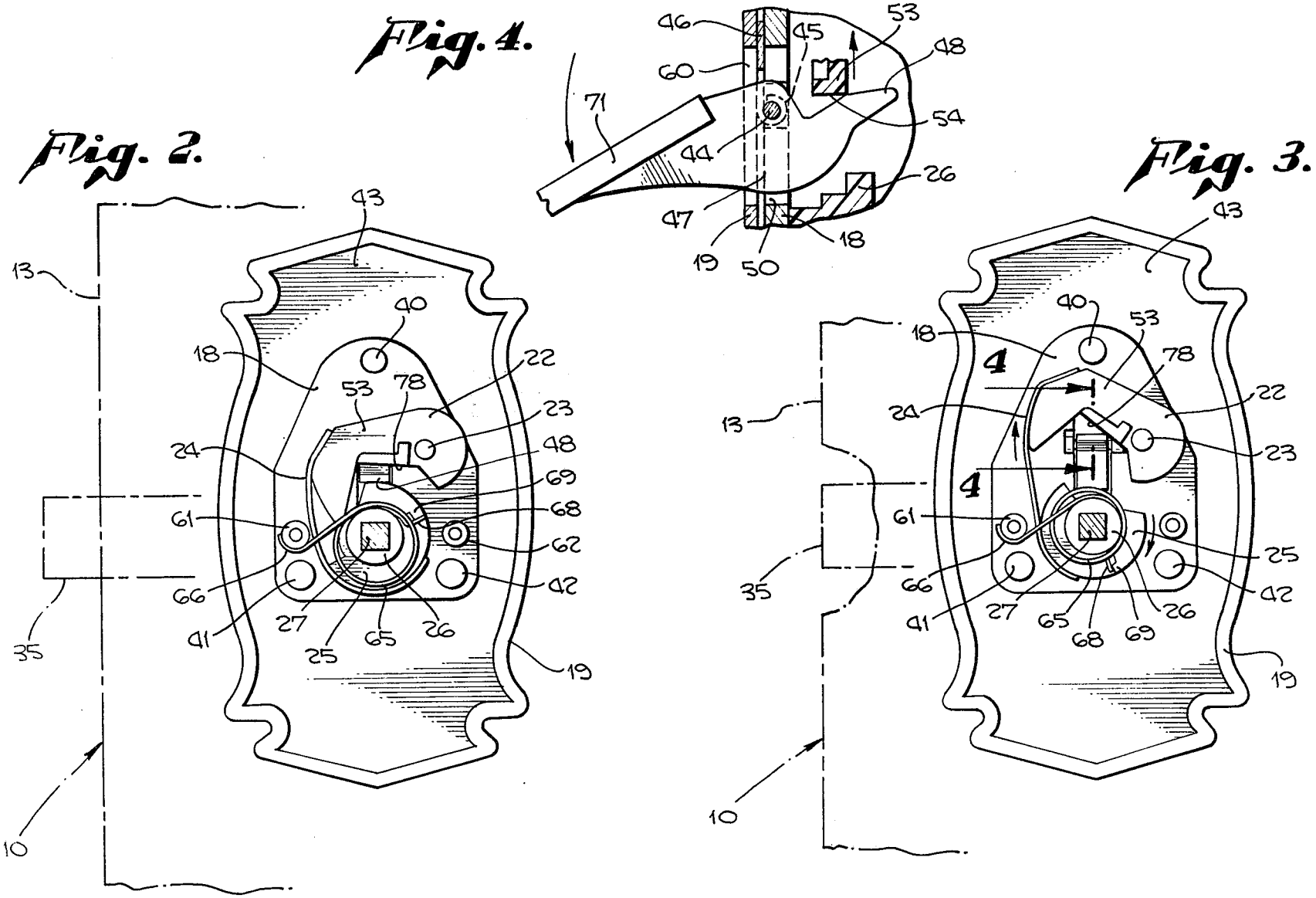
FIG. 2 is a vertical sectional view on the line 2—2 of FIG. 1, with the latch bolt extended.
FIG. 3 is a vertical sectional view similar to FIG. 2, except with the latch bolt retracted.
FIG. 4 is a fragmentary vertical sectional view on the line 4—4 of FIG. 3.

In an embodiment of the invention chosen for the purpose of illustration there is shown a conventional door, preferably a front door indicated generally by the reference character 10, having an outside face 11, an inside face 12, and an edge face 13. Purely for the purpose of orientation and environment, there is shown the exterior of a dead bolt mechanism 14. Below the dead bolt mechanism, is a door latch mechanism indicated generally by the reference character 15, featuring on the outside of the door a handle 16 and thumb piece 17, arranged to operate with a mounting plate 18 and escutcheon 19. On the inside face of the door is a knob 20, the knob 20 and thumb piece 17 together being adapted to manipulate a latch bolt subassembly indicated generally by the reference character 21. By pressing on the thumb piece 17, a bell crank 22 is pivoted about a pivot pin 23. Rotation of the bell crank 22 acting through a connector 24 rotates a flange 25 on a drum 26. This in turn rotates a spindle 27. The spindle 27 in turn rotates one section 28 of a split hub 29. One or another of ears 30, 31 acts against a roll back 32 of the latch bolt subassembly 21 to move the latch bolt to the withdrawn position of FIG. 10.

The knob 20 on the inside face of the door, when rotated, acts through a knob spindle 33 which manipulates another section 34 of the split hub 29. Ears 30' and 31' of the section 34, depending on the direction of rotation, act independently against one side or another of the roll back 32 in order to withdraw the latch bolt subassembly 21.

Following conventional practice, the latch bolt subassembly consists of a bolt head 35 which, when extended, is adapted to engage a suitable plate in the door frame (not shown). An end plate 36 on the edge face 13 of the door is provided with a hole 37 to accommodate the latch bolt head.

The novel concepts herein disclosed undertake to translate vertical linear motion of the thumb piece 17 into rotary motion for the drum 26 and spindle 27 in order, by rotating the ears 30, 31, to again generate horizontal linear motion in the latch bolt subassembly to withdraw the latch bolt.

The escutcheon 19 may be attached to the outside face 11 of the door 10 by reason of its attachment to the mounting plate 18 which in turn is secured by posts and sleeves 61, 62, extending through the door from the inside trim in a purely conventional manner. The mounting plate 18 is secured to the escutcheon 19 by the staking of three mount posts 40, 41, 42. As shown, the mounting plate 18 resides in a chamber 43 within the escutcheon 19.

For pivotally mounting the thumb piece 17, there is provided a pivot pin 44 retained in leaves 45 of the hinge 46. The mounting pin 44 protrudes through an appropriate transverse bore at a mid portion 47 of the thumb piece. On the opposite side of the pivot pin a finger 48 of the thumb piece is adapted to move upwardly against the bell crank 22, as previously noted. The thumb piece extends through a hole 60 in the escutcheon.

A simple expedient for retaining the hinge 46 in position resides in providing a transverse slot 49 in the mounting plate 18 for reception of the hinge leaves 45 and a vertical slot 50, through which the mid portion 47 of the thumb piece moves. The hinge is retained loosely in place by reason of engagement on one side against the inside face of the escutcheon 19 and on the other side against the mounting plate 18 (see FIG. 6).

As shown in FIG. 7, the pivot 23 for the bell crank 22 extends through an appropriate bore 51 of the bell crank, a threaded end 52 of the pivot being retained in an appropriate threaded aperture of the mounting plate 18. If preferred, the pivot pin may be staked to the mounting plate.

The bell crank has an arm 53 which provides a shoulder 54, against which a finger 48 of the thumb piece 17 is adapted to act. An extension 55 of the arm 53 terminates in an arcuate surface 56, over which the connector 24 extends. The connector is secured to the arm 53 by a key 56 in a complementary key slot hole 57.

At the other end of the connector 24 there is a key 58 retained in a key slot hole 59 in the flange 25 of the drum 26.

For holding the thumb piece normally in initial position, there is provided a torsion spring 65, one end 66 of which is anchored around one of the posts 61, 62, the post being appropriately attached to the mounting plate 18 and the opposite trim. A second end 68 of the torsion spring 65 engages a tab 69 on the flange 25 of the drum 26.

Not previously mentioned is the employment of a pivot pin 70, a head of which resides within a square recess 71 of the drum 26 to accommodate the square shank of the spindle 27. The pivot pin 70 has a reduced end portion 72 which may threadedly engage the mounting plate 18 or be staked to it in a conventional manner. A coil spring 75 in a spring pocket 76 of the spindle 27 acts between the spindle 27 and the drum 26 by way of the pivot pin 70 to normally urge the spindle toward the split hub 26. A metal disc 77 is employed between sections 28 and 34 of the split hub 29.

In operation, the latch bolt head at the end of a retract slide 38 is normally extended as shown in FIG. 9. A spring (not shown) may be employed within the retract slide to assist in extending the latch bolt head. Simultaneously, action of the torsion spring 65 tends to hold the spindle 27 in the position occupied when the latch bolt subassembly is extended. At the same time the thumb piece 17 is in elevated position. To manipulate the latch bolt subassembly from extended to the withdrawn position of FIG. 10, the thumb piece 17 is pressed downwardly, moving from the horizontal position of FIG. 1 to the depressed position of FIG. 4. This action lifts on the arm 53 of the bell crank 22, causing the bell crank to pivot in a clockwise direction as shown in FIGS. 2, 3, and 5, the finger 48 of the thumb piece sliding along a shoe 78 of the bell crank. As the bell crank rotates, the connector 24 is pulled upwardly, and this in turn causes the flange 25 and drum 26 to rotate in a clockwise direction, as viewed in FIGS. 2, 3 and 5. The result is a comparable rotation of the spindle 27 against tension in the torsion spring 65. When the parts have moved to the position shown in FIG. 3, and also FIG. 10, the latch bolt subassembly has been withdrawn. As promptly as pressure on the thumb piece 17 is released, the torsion spring acts to reverse rotation of the spindle 27, moving in a counterclockwise direction, in FIGS. 2, 3 and 5, and this action, together with action of the spring (not shown), contained within the latch bolt subassembly 21, returns the latch bolt subassembly to the extended position of FIG. 9. In this position, the other parts occupy the positions shown in FIGS. 2 and 5.

The coil spring assembly 5 for the spindle 27 is for the purpose of making the spindle adjustable for doors of different thickness.

It should further be noted that the connector 24 is preferably a flat band to improve its reliability and smooth working action, as it lies against a relatively flat, arcuate surface on the exterior of the flange 25 of the drum 26.

Having described the invention, what is claimed as new in support of Letters Patent is as follows:

1. A latch mechanism for a door in which a rectractable latch bolt is installed in the door, said latch mechanism comprising a mounting plate, a thumb piece having a contact portion thereon, said thumb piece having a pivotal mounting on the plate with the axis of rotation parallel to said plate for generating movement of said contact portion in a direction transverse relative to the axis of the pivotal mounting, a bell crank having a pivotal mounting on said plate on an axis of rotation spaced from and at right angles to the axis of rotation of said first pivotal mounting, a portion of said bell crank being in a position overlying said thumb piece, a spindle subassembly having a rotatable mounting on said plate on an axis of rotation spaced from and parallel to the axis of rotation of said bell crank, said spindle subassembly including means adopted to have a roll back association with said latch bolt, resilient means for releasably holding said spindle subassembly normally in a position wherein said latch bolt is extended, and drive means between said bell crank and said spindle subassembly having one part attached to the bell crank at a location spaced the same distance from the axis of rotation of said bell crank in all positions of rotation of said bell crank and another part attached to the spindle subassembly at a location spaced the same distance from the axis of rotation of said spindle subassembly at all positions of rotation of said spindle subassembly.

2. A latch mechanism as in claim 1 wherein the direction of movement of the contact portion of said thumb piece is in transverse alignment with the axis of rotation of said spindle subassembly.

3. A latch mechanism as in claim 1 wherein said spindle subassembly comprises a spindle shaft and a drum non-rotatably anchored to said shaft, said drive means being attached to said drum at the perimeter.

4. A latch mechanism as in claim 1 wherein said bell crank has an exterior perimetrical arcuate portion with said drive means extending over the arcuate portion and anchored to the bell crank adjacent one end of said arcuate portion.

5. A latch mechanism as in claim 1 wherein said bell crank has an exterior perimetrical arcuate portion and said spindle subassembly comprises a spindle shaft and a drum non-rotatably anchored to said shaft, a perimetrical arcuate portion on said drum having a position facing away from the exterior perimetrical arcuate portion of said bell crank, said drive means comprising a resilient connecting member overlying both said arcuate portions, opposite ends of said connecting member being attached respectively to said bell crank and said drum at ends of the respective arcuate portions remote from each other.

6. A latch mechanism as in claim 5 wherein said connecting member is a substantially flat resilient band and there is a torsion spring acting between said drum and said mounting plate biased normally in a direction urging said bell crank toward said thumb piece.

7. A latch mechanism as in claim 5 wherein said mounting plate is in an operative position spaced from the door providing mounting space and wherein said bell crank, said spindle subassembly and said thumb piece are mounted on the mounting plate with said drum, said bell crank and a portion of said thumb piece in operative engagement with the bell crank being located within said mounting space.

8. A latch mechanism as in claim 3 wherein said drum has a non-circular axial bore and said spindle shaft has a non-circular external form complementary with respect to said bore, there being an interior spring means acting axially between said drum and said shaft and biased in a direction to extend said shaft in a direction away from the drum toward engagement with said latch bolt.

* * * * *